US012357086B2

(12) United States Patent
Xiang et al.

(10) Patent No.: US 12,357,086 B2
(45) Date of Patent: Jul. 15, 2025

(54) EXERCISE BICYCLE WITH A DESK PLATE

(71) Applicant: Loctek Ergonomic Technology Corp., Zhejiang (CN)

(72) Inventors: Lehong Xiang, Zhejiang (CN); Tao Lin, Zhejiang (CN); Dajiang Zhao, Zhejiang (CN); Jie Zhao, Zhejiang (CN)

(73) Assignee: Loctek Ergonomic Technology Corp., Ningbo (CN)

( * ) Notice: Subject to any disclaimer, the term of this patent is extended or adjusted under 35 U.S.C. 154(b) by 464 days.

(21) Appl. No.: 17/515,564

(22) Filed: Nov. 1, 2021

(65) Prior Publication Data

US 2022/0047069 A1 Feb. 17, 2022

Related U.S. Application Data

(63) Continuation of application No. 15/870,952, filed on Jan. 14, 2018, now Pat. No. 11,191,352.

(30) Foreign Application Priority Data

May 25, 2017 (CN) ..... 201710388850.7

(51) Int. Cl.

| | |
|---|---|
| ***A47B 21/02*** | (2006.01) |
| ***A63B 22/00*** | (2006.01) |
| ***A63B 22/06*** | (2006.01) |

(52) U.S. Cl.

CPC ..... *A47B 21/02* (2013.01); *A63B 22/0015* (2013.01); *A63B 22/0046* (2013.01);

(Continued)

(58) Field of Classification Search

CPC ..... A63B 2225/093; A63B 2225/68; A63B 2210/50; A63B 2069/161;

(Continued)

(56) References Cited

U.S. PATENT DOCUMENTS 3,259,385 A * 7/1966 Boren ..... A63B 22/0694 248/165
5,115,723 A * 5/1992 Wang ..... A47C 3/30 188/300

(Continued)

FOREIGN PATENT DOCUMENTS

CN 2813421 Y * 9/2006
CN 103566535 A * 2/2014
CN 205042036 U * 2/2016

*Primary Examiner* — Zachary T Moore
(74) *Attorney, Agent, or Firm* — Zhigang Ma

(57) ABSTRACT

The present disclosure discloses an exercise bicycle with a desk plate, which comprises a frame, a supporting foot, a seat and a desk plate, the frame including a first upright column to support the desk plate and a second upright column to support the seat, wherein a first lifting assembly is provided on the first upright column to connect the desk plate and the first upright column, and enables the adjustment of the upper and lower positions of the desk plate relative to the first upright column. The height of the desk plate can be adjusted by the first lifting assembly to accommodate users with different figures. It's more ergonomic since the height of the upright column supporting the desk plate can be adjusted. When packing, lower the upright column to the minimum can largely reduce the size of the package.

8 Claims, 4 Drawing Sheets

(52) U.S. Cl.
CPC ..... *A63B 22/0605* (2013.01); *A63B 2210/50* (2013.01); *A63B 2225/093* (2013.01); *A63B 2225/68* (2013.01)

(58) Field of Classification Search
CPC ..... A63B 2069/162; A63B 2069/163; A63B 2069/164; A63B 2069/165; A63B 2069/166; A63B 2069/167; A63B 2069/168; A63B 69/16; A63B 2022/0635; A63B 2022/0641; A63B 2022/0647; A63B 2022/0652; A63B 2022/0658; A63B 6/0605; A63B 6/0694; A47B 21/02; A47B 21/0015; A47B 21/0046; A47B 21/0605; A47B 19/06; A47B 9/00; A47B 13/003
See application file for complete search history.

(56) References Cited

U.S. PATENT DOCUMENTS 5,372,562 A * 12/1994 Chang ..... A63B 22/0605 482/57
5,620,067 A * 4/1997 Bauer ..... F16F 9/0245 188/322.19
5,884,887 A * 3/1999 Garelick ..... A47C 1/023 248/416
6,079,786 A * 6/2000 Kirkland ..... B63B 29/06 248/416
6,397,761 B1 * 6/2002 Moore ..... A47B 9/10 108/50.01
8,485,945 B2 * 7/2013 Leonhard ..... A63B 22/0664 482/52
8,763,981 B2 * 7/2014 Friesen ..... F16F 9/0263 248/580
9,247,806 B2 * 2/2016 Lorenzen ..... A47B 9/20
2005/0248194 A1 * 11/2005 Hsien ..... A47C 1/023 297/344.11
2011/0263388 A1 * 10/2011 Tamari ..... A63B 22/0015 482/57
2012/0088634 A1 * 4/2012 Heidecke ..... A63B 22/0005 482/92
2012/0274046 A1 * 11/2012 Trout ..... B62H 1/12 280/298
2014/0024502 A1 * 1/2014 Watterson ..... A63B 22/0605 482/57
2014/0073489 A1 * 3/2014 Wu ..... A63B 22/0605 482/57
2017/0105523 A1 * 4/2017 McBride ..... A63B 22/0605

* cited by examiner

EXERCISE BICYCLE WITH A DESK PLATE

CROSS-REFERENCE TO RELATED APPLICATIONS

This application is a continuation of U.S. application Ser. No. 15/870,952, filed Jan. 14, 2018, which claims priority to Chinese Patent Application No. 201710388850.7, filed May 25, 2017. The contents of the aforementioned applications, including any intervening amendments thereto, are incorporated herein by reference.

TECHNICAL FIELD

The present disclosure relates to the field of fitness equipment, in particular to an exercise bicycle with a desk plate.

BACKGROUND

Exercise bicycles have gained great popularity, and for the purpose of working healthily, an exercise bicycle with a desk plate is introduced for office personnel to work out while handling office work. The desk plate can be used for placing laptops, mugs and other office related articles. People can exercise during work, which fulfils their pursuit of health.

However, the existing desk plate on the exercise bicycle is not adjustable, which is not very user-friendly for people with different figures. Moreover, the packaging of the existing exercise bicycle is large and inconvenient for transportation, and it costs a considerable amount of effort to install if it's tightly packed.

SUMMARY

The present disclosure discloses an exercise bicycle with a desk plate, convenient to adjust, small in size and easy to install.

The present disclosure discloses an exercise bicycle with a desk plate, which comprises a frame, a supporting foot, a seat and a desk plate, the frame including a first upright column to support the desk plate and a second upright column to support the seat, wherein a first lifting assembly is provided on the first upright column to connect the desk plate and the first upright column, and enables the adjustment of the upper and lower positions of the desk plate relative to the first upright column.

In the present disclosure, the users can adjust the height of the desk plate through the first lifting assembly, thus users with different heights and figures can all be accommodated. And it's more ergonomic since the height of the upright column supporting the desk plate can be adjusted. When packing, lower the upright column to the minimum can largely reduce the size of the package.

A second lifting assembly is provided on the second upright column to connect the seat and the second upright column, and enable the adjustment of the upper and lower positions of the seat relative to the second upright column. The user can adjust the seat with great convenience by adopting the above structure.

The first lifting assembly is arranged inside the first upright column, and the first lifting assembly comprises a first locking gas spring, a first sliding part and a first handle, the first handle is connected to the control end 12 of the first locking gas spring, and controls the locking and releasing of the first locking gas spring, one end of the first locking gas spring is arranged inside the lower end of the first upright column, the other end of the first locking gas spring is connected with the first sliding part, the first sliding part is connected with the bottom of the desk plate, a first handle is provided below the desk plate, when the first handle is pulled, the first locking gas spring is in the releasing state, and the desk plate can slide up and down relative to the first upright column, when the handle is loosened, the first locking gas spring is in the locking state, and the desk plate is locked relative to the first upright column. The assisting force provided by the locking gas spring of the lifting assembly makes it easier for the user to lift the desk plate. And it's convenient to operate while the user can sit on the exercise bicycle instead of getting off.

The first sliding part is a sleeve pipe, and the first upright column is a hollow tube, the first sliding part is sleeved inside the first upright column, and can be locked at any height through the first lifting assembly. It's relatively stable and the desk plate doesn't shake too much when adjusting the height of the desk plate since the sliding part is sleeved and matched with the first upright column.

The first lifting assembly adopts an electric linear driving device, the linear driving device is connected with the desk plate and the first upright column to control the lifting of the desk plate relative to the first upright column, a control button of the linear driving device is arranged on the desk plate. The user can adjust the height of the desk plate simply by pressing the button.

The second lifting assembly is arranged inside the second upright column. The second lifting assembly comprises a second locking gas spring, a second sliding part and a second handle, the second handle is connected to the control end of the second locking gas spring, and controls the locking and releasing of the second locking gas spring, one end of the second locking gas spring is arranged inside the lower end of the second upright column, the other end of the second locking gas spring is connected with the second sliding part, the second sliding part is connected with the bottom of the seat, a second handle is provided below the seat, when the second handle is pulled, the second locking gas spring is in the releasing state, and the seat can slide up and down relative to the second upright column, when the handle is loosened, the second locking gas spring is in the locking state, and the seat is locked relative to the second upright column. The user can achieve the height adjustment of the seat without getting off the exercise bicycle.

The second lifting assembly adopts an electric linear driving device, the linear driving device is connected with the seat and the second upright column to control the lifting of the seat relative to the second upright column, a control button of the linear driving device is arranged below the seat. In this way, the height of the seat can be electrically controlled.

The supporting foot is rotatably connected with the frame, a plurality of the supporting foots are provided and rotatably connected with the base independently. When packing, the supporting foot can be folded to the frame to reduce the size of package.

The supporting foot is provided with a gravity brake wheel. Instead of the original foot pad, the gravity brake wheel makes it easier to move the exercise bicycle when it's not in use. And when the user sits on the exercise bicycle, the gravity brake wheel is locked due to the gravity and will not rotate. Both ways are convenient for users.

Figure 1:
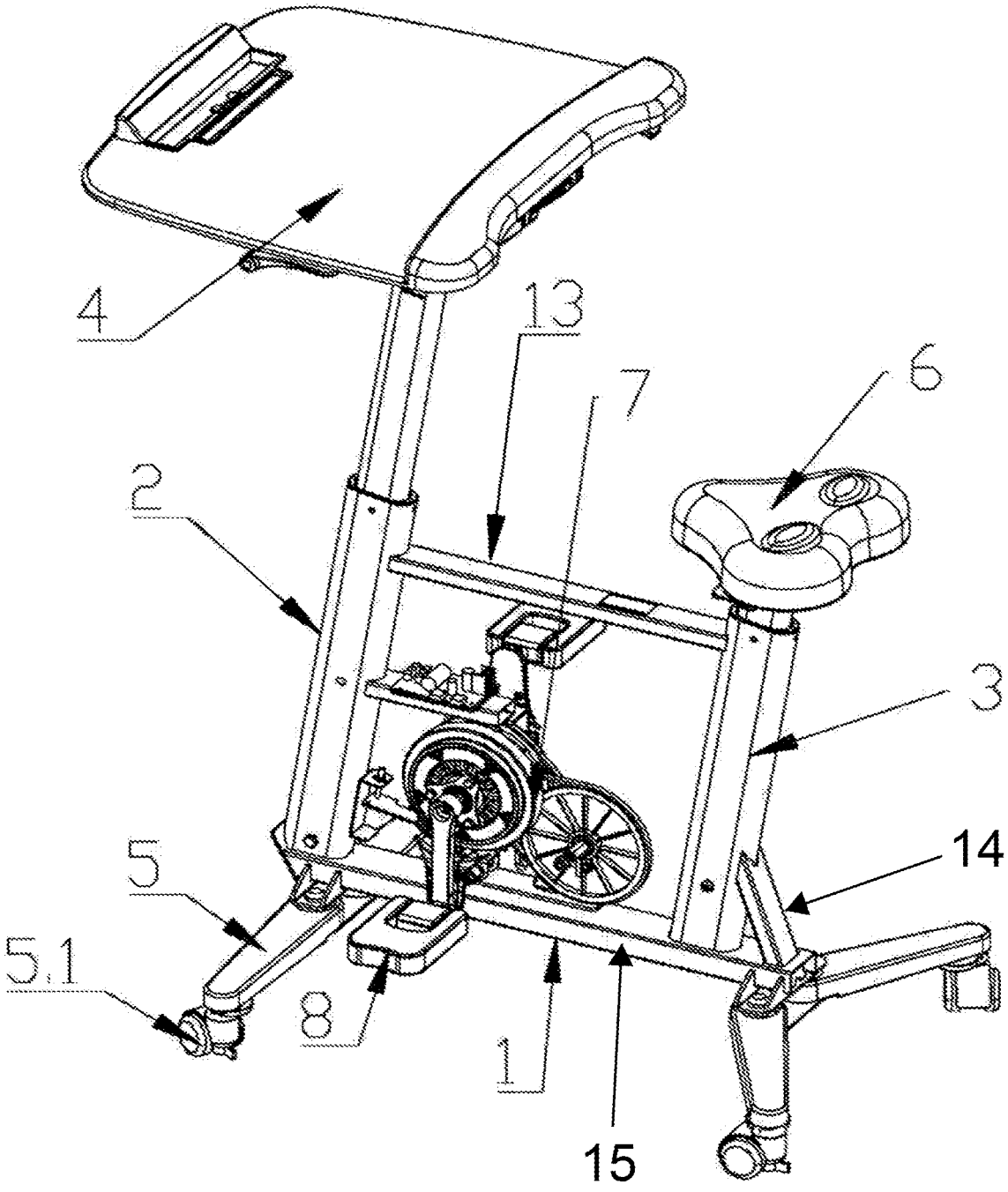
FIG. 1 is a structural schematic diagram of the exercise bicycle with a desk plate without cover.
Figure 2:
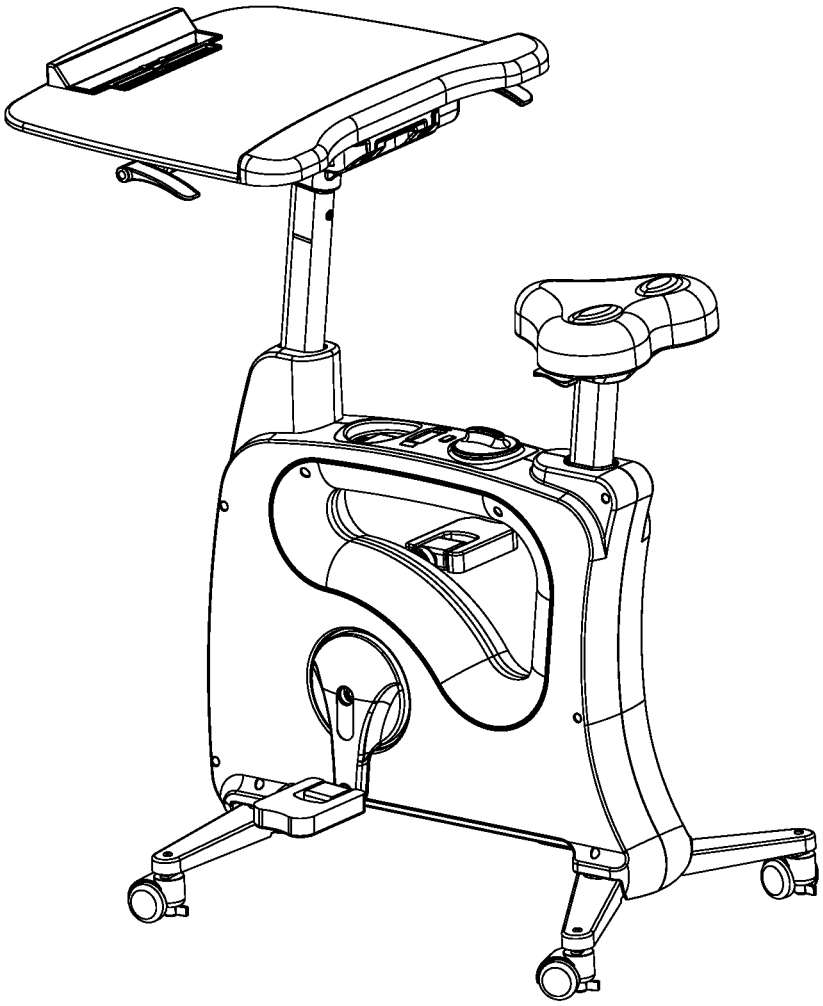
FIG. 2 is a schematic diagram of the exercise bicycle with a desk plate.

Reference Numbers: 1 frame, 2 upright column, 3 second upright column, 4 desk plate, 4.1 mounting seat for the desk plate, 5 supporting foot, 5.1 gravity brake wheel, 6 seat, 7 resistance device, 8 foot pedal, 9. resistance adjustment knob, 10.1 first sliding part, 10.2 first locking gas spring, 10.3 first handle, 10.4 rotating shaft, 10.5 pressing block, 10.6 ejector rod assembly, 10.7 fixing seat, 11.1 second sliding part, 11.2 second locking gas spring, 11.3 second handle, 12 control end, 13 supporting rod.

DETAILED DESCRIPTION

The present disclosure would be described in greater detail hereinafter in combination with the accompanying drawings and embodiments.

As shown in FIG. 1, FIG. 2, FIG. 3 and FIG. 4, the present disclosure provides an exercise bicycle with a desk plate which comprises a frame 1, a supporting foot 5, a seat 6 and a desk plate 4, the frame 1 including a first upright column 2 to support the desk plate 4 and a second upright column 3 to support the seat 6, wherein a first lifting assembly is provided on the first upright column 2 to connect the desk plate 4 and the first upright column 2, and enables the adjustment of the upper and lower positions of the desk plate 4 relative to the first upright column 2, it further comprises a supporting rod 13 and a cross rod 15 to connect the first upright column and the second upright column, and both sides of the cross rod 15 are respectively provided with two supporting feet, the four supporting feet are respectively arranged below the first upright column and the second upright column, and the two supporting feet below the second upright column forms a splayed structure, and the opening of the splayed structure faces away from the desk plate.

Figure 3:
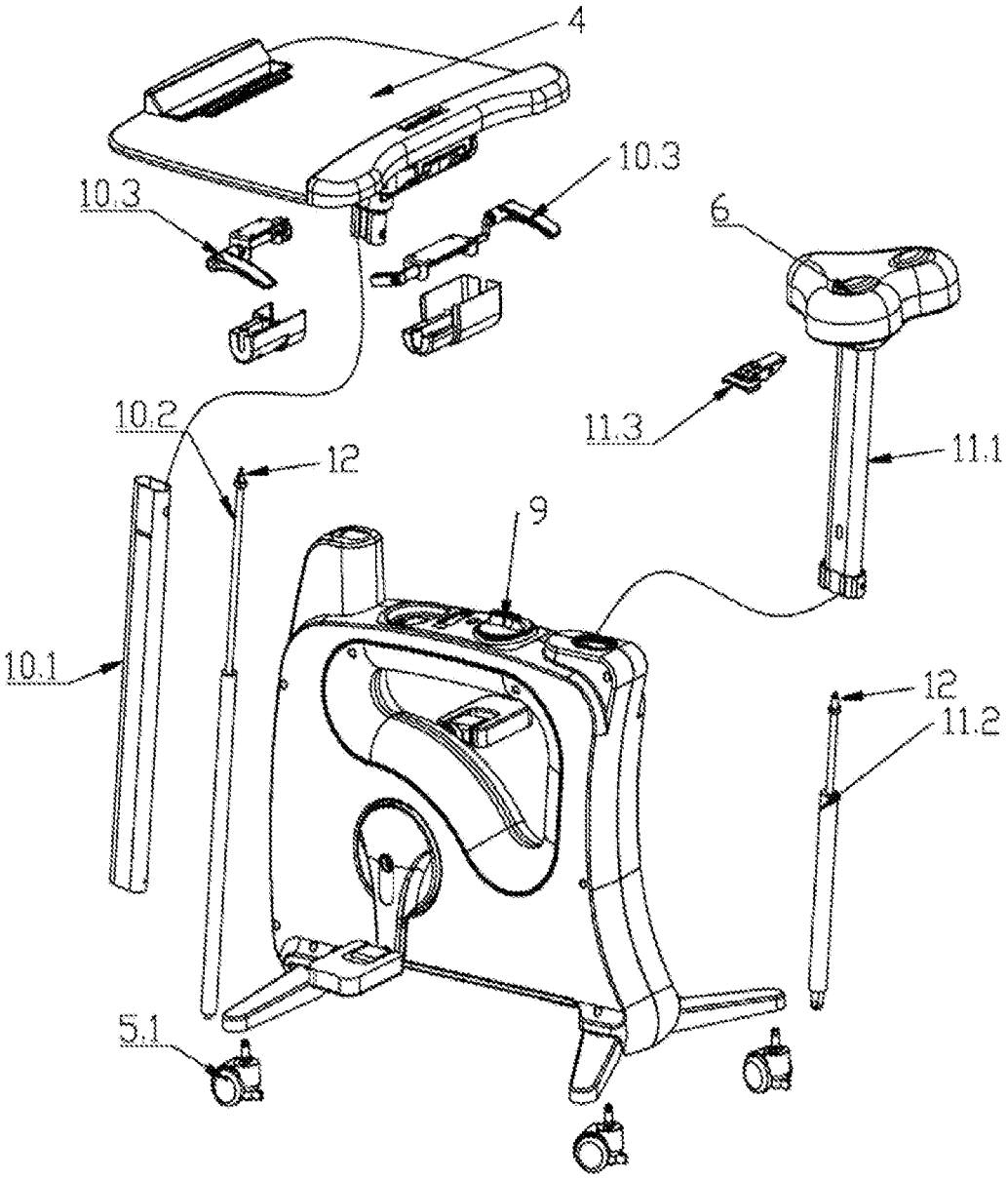
FIG. 3 is a partial explosive structural diagram of the exercise bicycle with a desk plate.

As shown in FIG. 1 and FIG. 3, the integral structure of frame 1 is of a square shape, and a cross rod 15 is provided at the bottom of the frame 1, a first upright column 2 in the front, a second upright column 3 in the rear, a reinforcing rod 14 is arranged between the second upright column 3 to increase the strength of the frame, one end of the reinforcing rod 14 is fixedly connected to the second upright column, and the other end is fixedly connected to the joint of the cross rod 15 and the splayed structure; a first sliding part 10.1 is provided on the first upright column 2, and the first sliding part is a sliding sleeve tube inside the first upright column, the sleeve tube is internally provided with a first locking gas spring 10.2, the lower end of the first locking gas spring 10.2 is a cylinder, which is connected to the frame within the first upright column 2, the upper end of the first locking gas spring is a piston rod, which is fixedly connected with the sleeve tube, a first handle 10.3 is provided below the desk plate, the first handle 10.3 is connected to the control valve of the first locking gas spring, and controls the locking and releasing of the first locking gas spring, one end of the first locking gas spring is arranged inside the lower end of the first upright column, the other end of the first locking gas spring is connected with the first sliding part, the first sliding part is connected with the bottom of the desk plate, a first handle is provided below the desk plate, when the first handle is pulled, the first locking gas spring is in the releasing state, and the desk plate can slide up and down relative to the first upright column, when the handle is loosened, the first locking gas spring is in the locking state, and the desk plate is locked relative to the first upright column. The user can complete the adjustment of the height of the desk plate while sitting on the exercise bicycle, no need to bother getting off frequently.

In this embodiment, the seat 6 is also adjusted by the locking gas spring. A second sliding part 11.1 is provided on the second upright column 3, and the second sliding part is a sliding sleeve tube inside the second upright column, the sleeve tube is internally provided with a second locking gas spring 11.2, the lower end of the second locking gas spring 11.2 is a cylinder, which is connected to the frame within the second upright column 3, the upper end of the second locking gas spring is a piston rod, which is fixedly connected with the sleeve tube, a second handle 11.3 is provided below the seat, the second handle 11.3 is connected to the control valve of the second locking gas spring, and controls the locking and releasing of the second locking gas spring. Users can adjust the height of the seat without getting off the exercise bicycle.

Figure 4:
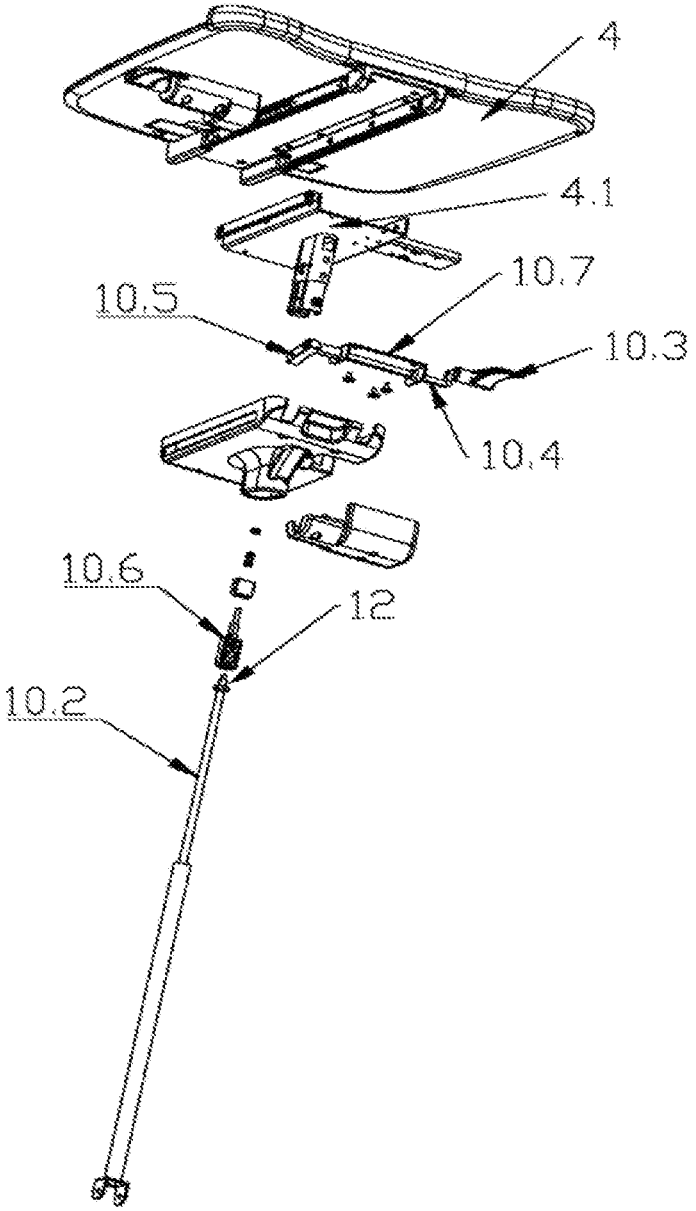
FIG. 4 is a schematic diagram illustrating the connection structure of the desk plate.

As shown in FIG. 4, the first handle 10.3 is arranged below the desk plate 4, the first handle 4 is mounted on the fixing seat for the desk plate below the desk plate 4 and connected with the first sliding part 10.1, a fixing seat 10.7 is provided below the desk plate 4 to connect the first handle 10.3; the first handle 10.3 is rotatably connected with the fixing seat 10.7 through a first rotating shaft 10.4; the other end of the rotating shaft 10.4 is connected with a pressing block 10.5, an ejector rod assembly 10.6 is arranged below the pressing block 10.5; the lower end of the ejector rod assembly 10.6 is connected with the control valve of the first locking gas spring; when the first handle 10.3 is rotated, the pressing block 10.5 is pressed to push the ejector rod assembly downwards, making the control valve of the first locking gas spring in a released state; when the first handle is loosened, the ejector rod assembly is reset automatically, making the control valve of the first locking gas spring closed.

The electrical linear driving device can also be applied to the first lifting assembly and the second lifting assembly in the present disclosure to adjust the height electrically. Other lifting structures such as lifting assembly composed with a pulley and a rope, or a normal gas spring with mechanical locking device can also be applied to the lifting assemble, which should be within the protection scope of the present disclosure.

The supporting foot 5 in the present disclosure is rotatably connected to the frame, and when in use, the supporting foot can be folded towards the frame to reduce the size of package. When the supporting foot unfolds, the spring pin of the supporting foot clamps into the positioning hole of the frame automatically to enhance the stability. There are four supporting feet in the embodiment, but the number of the supporting feet can be increased or reduced in actual application. As long as the supporting foot is rotatably connected to the frame, and can be folded to reduce the size of packaging, it should be within the protection scope of the present disclosure.

In the present disclosure, the gravity brake wheel 5.1 is provided below the supporting foot 5. Instead of the original foot pad, the gravity brake wheel makes it easier to move the exercise bicycle when it's not in use. And when the user sits on the exercise bicycle, the gravity brake wheel is locked due to the gravity and will not rotate, which is very convenient to use. The structural theory of the gravity brake wheel is not described in detail herein since the technology itself belongs to prior art.

What is claimed is:

1. An exercise bicycle with a desk plate, comprising a frame, a seat and the desk plate, the frame including a first upright column to support the desk plate and a second upright column to support the seat, a supporting rod and a cross rod to connect the first upright column and the second upright column, the cross rod is located at a bottom of the first upright column and the second upright column, a first sliding part is provided on the first upright column to connect the desk plate and the first upright column, the first sliding part is configured to enable adjustment of upper and lower positions of the desk plate relative to the first upright column, wherein both sides of the cross rod are respectively provided with two supporting feet, the four supporting feet are respectively arranged below the first upright column and the second upright column, wherein two of the four supporting feet are below the second upright column and form a splayed structure, and an opening of the splayed structure faces away from the desk plate, and wherein the cross rod is provided with a reinforcing rod, and one end of the reinforcing rod is fixedly connected to the second upright column, and another end is fixedly connected to the joint of the cross rod and the splayed structure.

2. The exercise bicycle with the desk plate of claim 1, wherein the frame is of a quadrilateral shape.

3. The exercise bicycle with the desk plate of claim 2, wherein the quadrilateral shape is of a square shape.

4. The exercise bicycle with the desk plate of claim 1, further comprising a first locking gas spring and a first handle, the first handle is connected to a control end of the first locking gas spring, and controls locking and releasing of the first locking gas spring, one end of the first locking gas spring is arranged inside a lower end of the first upright column, another end of the first locking gas spring is connected with the first sliding part, the first sliding part is connected with a bottom of the desk plate, the first handle is provided below the desk plate, wherein when the first handle is pulled, the first locking gas spring is in a releasing state, and the desk plate can slide up and down relative to the first upright column, and wherein when the handle is loosened, the first locking gas spring is in a locking state, and the desk plate is locked relative to the first upright column.

5. The exercise bicycle with the desk plate of claim 4, wherein the first sliding part is a sleeve pipe, and the first upright column is a hollow tube, the first sliding part is sleeved inside the first upright column.

6. The exercise bicycle with the desk plate of claim 5, wherein a second sliding part is provided on the second upright column to connect the seat and the second upright column, and enable the adjustment of the upper and lower positions of the seat relative to the second upright column.

7. The exercise bicycle with the desk plate of claim 6, further comprising a second locking gas spring and a second handle, the second handle is connected to a control end of the second locking gas spring, and controls locking and releasing of the second locking gas spring, one end of the second locking gas spring is arranged inside a lower end of the second upright column, another end of the second locking gas spring is connected with the second sliding part, the second sliding part is connected with a bottom of the seat, the second handle is provided below the seat, wherein when the second handle is pulled, the second locking gas spring is in a releasing state, and the seat can slide up and down relative to the second upright column, and wherein when the handle is loosened, the second locking gas spring is in a locking state, and the seat is locked relative to the second upright column.

8. The exercise bicycle with the desk plate of claim 7, wherein the second sliding part is a sleeve pipe, and the second upright column is a hollow tube, the second sliding part is sleeved inside the second upright column.

* * * * *